United States Patent [19]

Jozepaitis

[11] 4,392,783

[45] Jul. 12, 1983

[54] LIQUID RING PUMP EMPLOYING DISCHARGED PUMPING LIQUID FOR DISCHARGE PORT CONTROL

[75] Inventor: Charles M. Jozepaitis, Bridgeport, Conn.

[73] Assignee: The Nash Engineering Company, Norwalk, Conn.

[21] Appl. No.: 215,577

[22] Filed: Dec. 12, 1980

[51] Int. Cl.[3] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,180,613 | 4/1916 | Siemen . | |
| 1,699,326 | 1/1929 | Durdin . | |
| 1,699,327 | 1/1929 | Durdin . | |
| 1,864,640 | 6/1932 | Dalrymple . | |
| 2,344,396 | 3/1944 | Dardelet | 230/79 |
| 2,453,373 | 11/1948 | Kollsman | 230/79 |
| 3,108,738 | 10/1963 | Luhmann | 230/79 |
| 3,217,975 | 11/1965 | Jennings | 230/79 |
| 3,289,918 | 12/1966 | Adams | 230/79 |
| 3,348,766 | 10/1967 | Mugele | 230/79 |
| 3,366,314 | 1/1968 | Schroder | 230/79 |
| 3,588,283 | 6/1971 | Fitch | 417/68 |
| 3,707,337 | 12/1972 | Segebrecht | 417/68 |
| 3,721,508 | 3/1973 | Mugele | 417/68 |
| 3,771,898 | 11/1973 | Segebrecht | 415/53 |
| 3,884,596 | 5/1975 | Hoffmeister | 417/68 |

FOREIGN PATENT DOCUMENTS

| | | |
|---|---|---|
| 1503605 | 4/1969 | Fed. Rep. of Germany . |
| 2704863 | 8/1978 | Fed. Rep. of Germany . |
| 455717 | 8/1913 | France . |
| 863015 | 3/1941 | France . |
| 26049 | 7/1915 | Norway . |
| 237843 | 9/1945 | Switzerland . |
| 7769 | of 1914 | United Kingdom . |
| 542075 | 12/1941 | United Kingdom . |

*Primary Examiner*—Edward K. Look

*Attorney, Agent, or Firm*—Robert R. Jackson; David W. Plant

[57] ABSTRACT

A liquid ring pump having at least two discharge port portions communicating respectively with relatively low and relatively high pressure portions of the compression zone in the pump, and a discharge chamber communicating with the discharge port portions for causing excess pumping liquid discharged from the discharge port to flow transversely over the discharge port portion communicating with the relatively low pressure portion of the compression zone.

1 Claim, 6 Drawing Figures

LIQUID RING PUMP EMPLOYING DISCHARGED PUMPING LIQUID FOR DISCHARGE PORT CONTROL

BACKGROUND OF THE INVENTION

This invention relates to liquid ring pumps, and more particularly to automatic control of the discharge ports in liquid ring pumps for enhancing the performance of the pump over an extended operating range.

The typical liquid ring pump has a rotor with generally radial blades eccentrically mounted for rotation in an annular housing. A quantity of pumping liquid (e.g., water) is maintained in the housing so that when the rotor rotates, the rotor blades engage the liquid and form it into an annular ring which circulates around the inner periphery of the housing with approximately the same angular velocity as the rotor. The rotor and its blades cooperate with the liquid ring to convey gas from an intake zone, where gas is admitted to the pump, to a compression zone, where the gas is discharged from the pump at a higher pressure than the intake pressure. As used herein and in the appended claims, the term "gas" means any gas, vapor, or gas-vapor mixture to be pumped.

The compression zone in a liquid ring pump has an appreciable pressure gradient circumferentially of the pump. The discharge port through which gas is discharged from the compression zone necessarily has appreciable circumferential extent. Accordingly, various portions of this discharge port typically sense different pressures along the pressure gradient of the compression zone. To achieve different compression ratios (compression ratio being defined herein to mean the ratio of discharge pressure to intake pressure, both pressures being measured external to the pump) it may therefore be necessary or desirable to effectively change the size and/or location of the discharge port, e.g., by selectively closing off certain segments or portions of the discharge port. For example, when a liquid ring pump being used as a vacuum pump is first started, it is typically operating at a low compression ratio and pumping a large quantity of gas. A discharge port extending circumferentially into the relatively low pressure portion of the compression zone is then desirable to prevent over-compression of the gas prior to discharge. Such over-compression undesirably increases the power required to operate the pump while the overpressure condition exists. The pump may therefore have to be provided with a significantly larger motor than would otherwise be required in order to meet these relatively infrequent requirements. After the vacuum pump has been in operation for some time, the compression ratio typically increases and the quantity of gas pumped decreases. To extend the operating range of the pump (i.e., to increase the compression ratio attainable), it would be desirable to close off the portion of the discharge port communicating with the relatively low pressure portion of the compression zone. This prevents gas discharged from the pump via the relatively high pressure portion of the discharge port from re-entering the pump via the relatively low pressure portion of the discharge port.

Pumps with various types of mechanical check valves for selectively closing off portions of the discharge port have been proposed. Most such devices have such disadvantages as sticking, wear, or failure.

It is therefore an object of this invention to provide improved and simplified liquid ring pumps.

It is a more particular object of this invention to provide improved and simplified means for controlling the effective size and/or location of the discharge port in liquid ring pumps.

SUMMARY OF THE INVENTION

These and other objects of the invention are accomplished in accordance with the principles of the invention by providing a liquid ring pump with first and second discharge port portions communicating, respectively, with relatively low and relatively high pressure portions of the compression zone in the pump, and a discharge chamber communicating with the first and second discharge port portions for directing pumping liquid discharged from the discharge port transversely over the first discharge port portion to substantially prevent gas from entering the compression zone via the first discharge port portion when pressure in the relatively low pressure portion of the compression zone is less than the gas pressure in the discharge chamber. The discharge chamber is shaped so that the kinetic energy of the pumping liquid discharged from the discharge port (primarily the second discharge port portion) produces a swirling recirculating flow of pumping liquid around the inner periphery of the discharge chamber, at least when the pump is operating at a relatively high compression ratio. The flow is directed transversely over the first discharge port portion as mentioned above. A gas discharge outlet is provided in the discharge chamber where there is good separation of the liquid and gas discharged from the pump and where the outlet will not interfere with the circulation of pumping liquid around the inner periphery of the discharge chamber. Preferably, the gas discharge outlet is located in the central portion of the discharge chamber bounded by the circulating pumping liquid. One or more baffles may be provided in the discharge chamber to promote the desired circulation of pumping liquid.

Further features of the invention, its nature and various advantages will be more apparent from the accompanying drawing and the following detailed description of the invention.

DETAILED DESCRIPTION OF THE INVENTION

Figure 1:
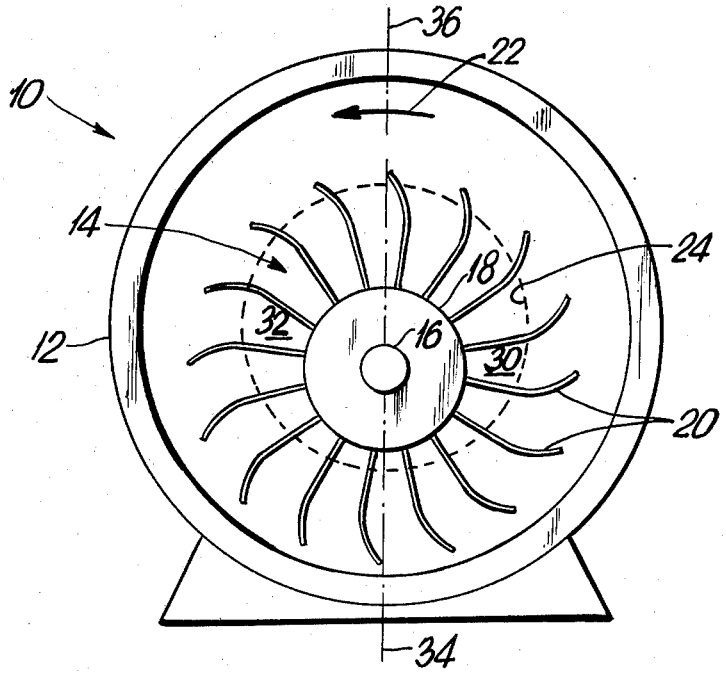
FIG. 1 is a simplified elevational sectional view showing the interior of a typical liquid ring pump.

As shown in FIG. 1, a typical liquid ring pump 10 has an annular housing 12 within which a rotor 14 is eccentrically mounted on a rotatable shaft 16. Rotor 14 has an annular hub 18 and a plurality of blades 20 extending radially outward from the hub. Shaft 16 and rotor 14 are rotated in the direction indicated by the arrow 22 in FIG. 1. A quantity of pumping liquid is maintained in housing 12 so that the effect of blades 20 on this liquid is to produce a continuous ring of liquid around the inner periphery of housing 12. The approximate location of the inner surface of this liquid ring is indicated by the broken line 24 in FIG. 1. The liquid in the liquid ring circulates around the inner periphery of housing 12 with approximately the same angular velocity as rotor 14.

The pump of FIG. 1 may be generally characterized as having an intake zone 30 and a compression zone 32, both of these zones being located between the outer periphery of rotor hub 18 and the inner periphery 24 of the liquid ring. Intake zone 30 extends circumferentially in the direction of rotor rotation approximately 180° from the land radius 34 of the pump to its crown radius 36. Compression zone 32 extends circumferentially in the direction of rotor rotation approximately 180° from crown radius 36 to land radius 34. Land radius 34 extends from the center of shaft 16 through the point where the tips of blades 20 come closest to housing 12. Crown radius 36 extends from the center of shaft 16 through the point where the tips of blades 20 are most distant from housing 12. Gas admitted to the pump in intake zone 30 is conveyed to compression zone 32 by blades 20. In compression zone 32 the gas is compressed by cooperation of blades 20 and the liquid ring and the pressurized gas is then discharged from the pump. Although the pump shown in FIG. 1 has only one cycle per revolution, it will be understood that the pump may have two or more cycles per revolution and it will be readily apparent how the principles of the invention may be applied to such pumps.

Figure 2:
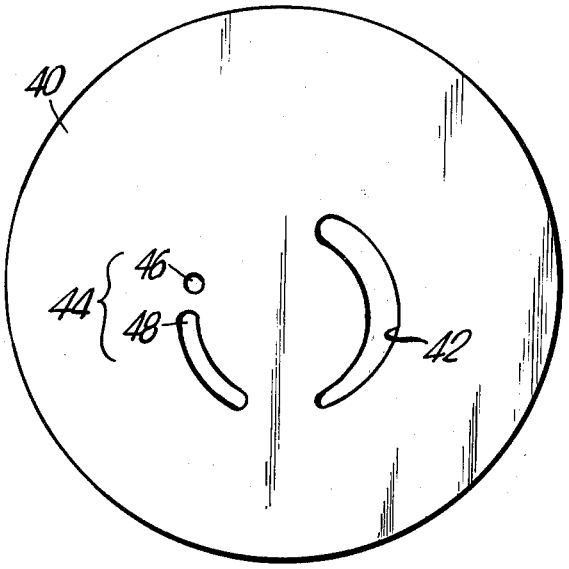
FIG. 2 is an elevational view of a port plate for use on the pump of FIG. 1 in accordance with the principles of this invention.

The end of pump 10 which is exposed in FIG. 1 is covered by a substantially flat port plate 40 shown in FIG. 2. Port plate 40 has an intake port 42 communicating with intake zone 30 and a discharge port 44 (including separate discharge port portions 46 and 48) communicating with compression zone 32. Gas is admitted to the pump via intake port 42 and, after compression as described above, is discharged via discharge port 44. It will be noted that discharge port portion 46 communicates with a relatively low pressure portion of compression zone 32, while discharge port portion 48 communicates with a relatively high pressure portion of compression zone 32. In the preferred embodiment shown in FIG. 2, a discharge port portion 46 is a relatively small circular opening, while discharge port portion 48 is a larger, generally crescent or kidney shaped opening.

Figure 3:
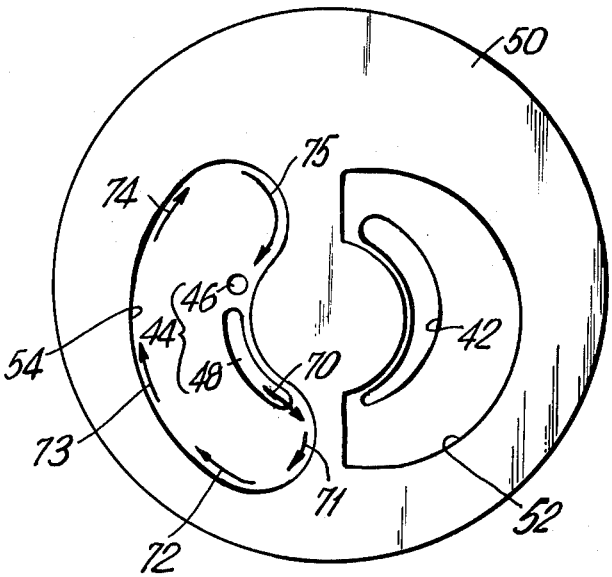
FIG. 3 is an elevational view of a manifold plate covering portions of the port plate of FIG. 2 in accordance with the invention.
Figure 4:
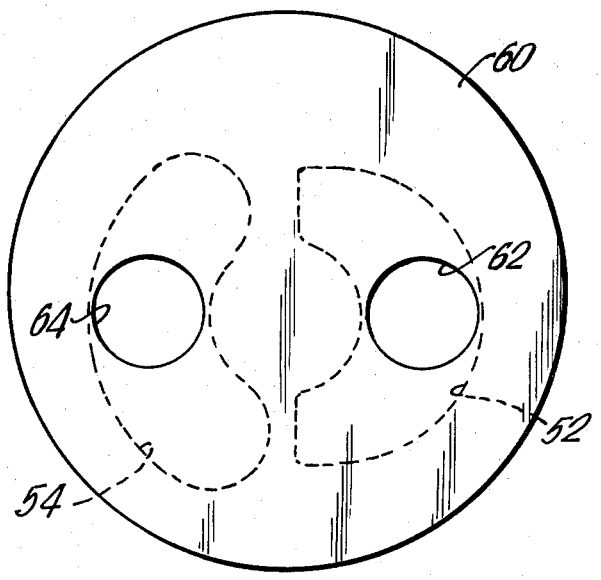
FIG. 4 is an elevational view of a cover plate for use over the manifold plate of FIG. 3 in accordance with the invention.

Port plate 40 is partially covered by manifold plate 50 shown in FIG. 3, and manifold plate 50 is covered in turn by cover plate 60 shown in FIG. 4. Manifold plate 50 (together with plates 40 and 60) define separate intake and discharge chambers 52 and 54 which respectively communicate with intake and discharge ports 42 and 44. Cover plate 60 has intake and discharge orifices 62 and 64 communicating, respectively, with intake and discharge chambers 52 and 54. Gas supplied to the pump via intake orifice 62 passes through intake chamber 52 and into intake port 42. Compressed gas discharged from the pump via discharge port 44 passes through discharge chamber 54 and exits from the pump via discharge orifice 64.

In operation, pump 10 discharges both compressed gas and excess pumping liquid from the liquid ring via discharge port 44. The pumping liquid discharged from the pump is continuously replaced via one or more pumping liquid supply conduits (not shown) so that there is a substantially continuous flow of excess pumping liquid from the pump. Most of the excess pumping liquid is discharged from higher pressure discharge port portion 48. The excess pumping liquid is discharged with a substantial component of velocity similar to the velocity of the pumping liquid in the adjacent portion of the liquid ring. The excess pumping liquid therefore enters discharge chamber 54 with substantial kinetic energy or momentum tending to cause it to continue to flow in the direction of flow of the adjacent portion of the liquid ring. Thus the excess pumping liquid exiting from discharge port portion 48 tends, with considerable force, to flow in a direction circumferentially away from discharge port portion 46, i.e., in the general direction of arrow 70 in FIG. 3.

Discharge chamber 54, particularly the outer periphery of discharge chamber 54, is shaped to make use of the above-described kinetic energy or momentum of the discharged excess pumping liquid to redirect the flow of that liquid so that it ultimately tends to flow transversely over lower pressure discharge port portion 46 as indicated by the sequence of arrows 71–75 in FIG. 3. For this purpose, in the preferred embodiment shown in FIG. 3, the outer periphery of discharge chamber 54 is preferably crescent or kidney shaped with gradually curved or rounded ends. Discharge chamber 54 thus first directs the excess pumping liquid flow radially outward from discharge port portion 48 (arrow 71). Discharge chamber 54 then directs the excess pumping liquid flow circumferentially back past both portions of discharge port 44 (arrows 72–74). And finally, discharge chamber 54 directs the excess pumping liquid flow radially inward and circumferentially toward discharge port portion 46 (arrow 75) so that the liquid flows transversely over discharge port portion 46 as mentioned above. At least a portion of the liquid passing over discharge port portion 46 may continue on and flow transversely over at least a portion of discharge port portion 48 where it is entrained with freshly discharged excess pumping liquid and starts around the circuit 70–75 again. Discharge chamber 54 therefore promotes a swirling recirculating flow of excess pumping liquid from discharge port portion 48 around the outer periphery of chamber 54 and transversely over discharge port portion 46.

Discharge orifice 64 is preferably located relative to discharge chamber 54 so that it does not interfere with this swirling flow of pumping liquid in chamber 54, e.g., by permitting premature discharge of the pumping liquid from the chamber. Thus discharge orifice 64 is preferably located centrally of chamber 54 in the area surrounded or bounded by the swirling flow of pumping liquid.

Discharge chamber 54 preferably does not fill completely with pumping liquid so that the pumping liquid in discharge chamber 54 does not exert substantial back pressure on the gas and fluid being discharged from the pump via discharge port 44. Moreover, the structure of discharge chamber 54 tends to promote good separation of the liquid and gas discharged from the pump. The liquid tends to flow around the outer periphery of chamber 54, expelling gas toward the center of the chamber in the manner of a centrifuge. Thus the gas tends to exit promptly from discharge chamber 54 via centrally located discharge orifice 64, while the excess pumping liquid flowing transversely over discharge port portion 46 tends to be relatively free of gas as is most desirable for effectively sealing that discharge port portion.

The flow of excess pumping liquid over low pressure discharge port portion 46 allows gas to be readily discharged from the pump via that discharge port portion when pressure in the adjacent portion of compression zone 32 is higher than the gas pressure in discharge chamber 54. This prevents over-compression in the pump when the pump is operating at a low compression ratio and pumping relatively large quantities of gas (e.g., during start-up of a vacuum pump). On the other hand, the flow of excess pumping liquid over discharge port portion 46 tends to close off or seal that discharge port portion when pressure in the adjacent portion of compression zone 32 falls below the pressure in discharge chamber 54. The flow of excess pumping liquid over discharge port portion 46 substantially prevents gas from re-entering compression zone 32 fom discharge chamber 54 via discharge port portion 46. Thus the controlled flow of pumping liquid in discharge chamber 54 in accordance with this invention automatically adjusts the performance characteristics of the pump to meet various pump operating conditions. The efficiency of the pump is increased and its operating range is extended (i.e., the maximum attainable compression ratio is increased).

Figure 5:
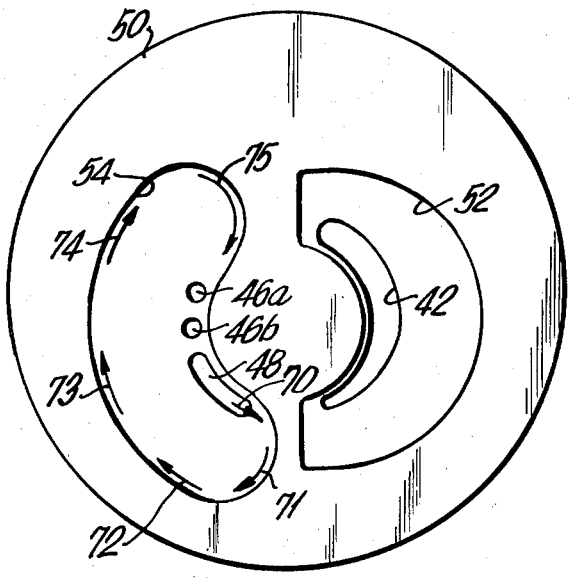
FIG. 5 is a view similar to FIG. 3 showing an alternative embodiment of the invention.

The invention is not limited to pumps having only two discharge port portions located as shown in the embodiments of FIGS. 1–4, but is also applicable to pumps having other numbers and arrangements of discharge port portions. FIG. 5, for example, shows an alternative embodiment of the invention in which the discharge port has three portions 46*a*, 46*b*, and 48. In other respects, the pump of FIG. 5 may be similar to the pump of FIGS. 1–4. Thus discharge port portions 46*a*, 46*b*, and 48 communicate, respectively, with low, intermediate, and high pressure portions of compression zone 32 in the pump. Discharge chamber 54 directs the flow of excess pumping liquid discharged from the pump around the outer periphery of chamber 54, transversely over discharge port portion 46*a*, and then transversely over discharge port portion 46*b*.

In operation, the flow of pumping liquid allows discharge port portions 46*a* and 46*b* to discharge gas when the pump is pumping a large quantity of gas at low compression ratios. As the quantity of gas being pumped decreases and the compression ratio increases, the flow of pumping liquid first effectively seals or closes discharge port portion 46*a* by substantially preventing gas from flowing back into the pump via discharge port portion 46*a*. With even further decrease in the quantity of gas being pumped and with further increase in the compression ratio, the flow of pumping liquid additionally effectively seals or closes discharge port portion 46*b* to substantially prevent gas from flowing back into the pump via the port portion.

Those skilled in the art will appreciate that other configurations and arrangements of the discharge port portions are possible.

Figure 6:
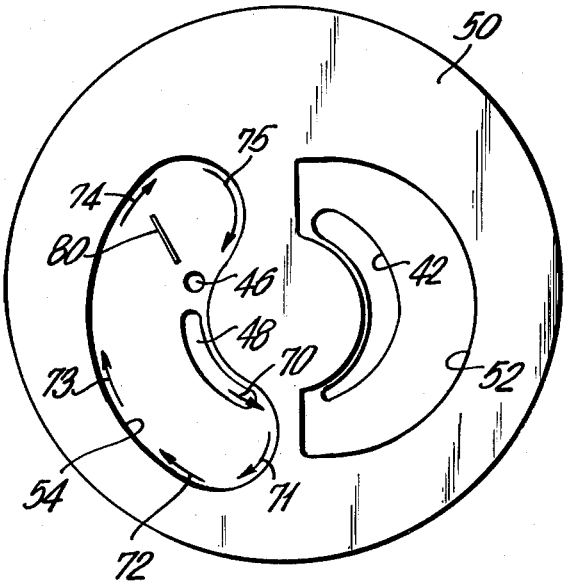
FIG. 6 is a view similar to FIGS. 3 and 5 showing another alternative embodiment of the invention.

FIG. 6 shows another alternative embodiment of the invention in which baffle 80 is provided in discharge chamber 54 to help direct the flow of excess pumping liquid circulating in discharge chamber 54 transversely over discharge port portion 46. Baffle 80 extends through discharge chamber 54 from port plate 40 to cover plate 60 and helps assure that excess pumping liquid which reaches the top of chamber 54 flows down over discharge port portion 46. In other respects, the pump of FIG. 6 may be similar to the pumps of FIGS. 1–4 or 5. Other baffle arrangements may similarly be used to help promote the recirculating flow of excess pumping liquid in the discharge chamber.

It will be understood that the particular embodiments shown and described herein are illustrative of the principles of the invention only, and that various modifications can be implemented by those skilled in the art without departing from the scope and spirit of the invention. For example, various discharge port configurations can be used as illustrated in FIGS. 3 and 5.

I claim:

1. In a liquid ring pump having a bladed rotor eccentrically mounted for rotation in an annular housing supplied with a quantity of pumping liquid, the rotor producing an annular ring of circulating pumping liquid in the housing when rotated and cooperating with the ring of pumping liquid to convey gas from an intake zone to a compression zone having a higher pressure than the intake zone, the improvement comprising:

a first discharge port portion in the housing communicating with a first relatively low pressure portion of the compression zone;

a second discharge port portion in the housing communicating with a second relatively high pressure portion of the compression zone;

a discharge chamber communicating with the first and second discharge port portions for directing a flow of pumping liquid discharged from the second discharge port portion transversely over the first discharge port portion to substantially prevent gas from entering the compression zone via the first discharge port portion when the pressure in the first portion of the compression zone is less than the gas pressure in the discharge chamber, the discharge chamber being shaped to make use of the kinetic energy of the pumping liquid discharged from the second discharge port portion to induce a substantially continuous recirculation of pumping liquid in the discharge chamber, the path of recirculation being (1) circumferentially away from the second discharge port portion in the direction of rotor rotation, (2) radially outward from the second discharge port portion and circumferentially in the direction opposite the direction of rotor rotation, (3) radially inward after passing both the second and first discharge port portions, and (4) circumferentially over the first discharge port portion in the direction of rotor rotation;

baffle means disposed in the discharge chamber for promoting recirculation of the pumping liquid in the discharge chamber; and a gas discharge outlet communicating with a portion of the discharge chamber bounded by the recirculating pumping liquid for allowing gas to exit from the discharge chamber without interfering with the recirculation of pumping liquid in the discharge chamber.

* * * * *